US005641203A

United States Patent [19]

Van De Riet et al.

[11] Patent Number: 5,641,203

[45] Date of Patent: Jun. 24, 1997

[54] ADJUSTABLE ARM REST ASSEMBLY

[75] Inventors: Douglas M. Van De Riet, Holland, Mich.; Jeffrey A. Weber, Minneapolis, Minn.

[73] Assignee: Herman Miller Inc., Zeeland, Mich.

[21] Appl. No.: 482,175

[22] Filed: Jun. 7, 1995

[51] Int. Cl.[6] ..... A47C 7/54

[52] U.S. Cl. ..... 297/411.37; 297/411.36; 297/411.38

[58] Field of Search ..... 297/411.31, 411.37, 297/411.38, 411.35; 248/118

[56] References Cited

U.S. PATENT DOCUMENTS

| | | | |
|---|---|---|---|
| 4,085,967 | 4/1978 | Spencer | 297/411.37 X |
| 4,961,610 | 10/1990 | Reeder et al. | 297/412 |
| 5,056,863 | 10/1991 | DeKraker et al. | 297/411 |
| 5,368,365 | 11/1994 | Feldberg | 297/411.36 |
| 5,407,249 | 4/1995 | Bonutti | 297/411.38 X |
| 5,415,459 | 5/1995 | Schultz | 297/411.37 |
| 5,439,267 | 8/1995 | Peterson et al. | 297/411.36 |
| 5,439,268 | 8/1995 | Dozsa-Farkas | 297/411.38 X |
| 5,484,187 | 1/1996 | Doerner et al. | 297/411.37 X |

*Primary Examiner*—Laurie K. Cranmer
*Attorney, Agent, or Firm*—Brinks Hofer Gilson & Lione

[57] ABSTRACT

An adjustable arm rest assembly for use on a chair including an arm rest post and an arm rest support surface. According to one aspect of the invention, the support surface is pivotably attached to a top surface of the arm rest post. The support surface includes a front portion and a rear portion and is pivotable about a pivot axis that extends in parallel with the seat back of the chair. A locking element is attached to one of the arm rest post and the support surface. The locking element includes a front portion and a rear portion with the front portion including a first mating element. The front portions of the support surface and locking element are farther from the seat back than the rear portions. A guide member is attached to the other of the arm rest post and the support surface. The guide member is located adjacent the front portion of the locking element and is adapted to receive the first mating element into one of a plurality of second mating elements. The locking element and the guide member are movable with respect to one another so that the support surface may be secured in a selected position relative to the arm rest post.

24 Claims, 3 Drawing Sheets

ADJUSTABLE ARM REST ASSEMBLY

BACKGROUND OF THE INVENTION

The present invention relates to the field of arm rests for use on chairs. More particularly, the invention relates to the field of arm rests which are adjustable to various positions to provide a more comfortable chair for a user.

Chairs, particularly office chairs, are often designed with the arm rests secured in a fixed position based on the intended use of the chair and the average size of the expected users. However, in an office environment, people of different sizes may spend many hours in the same size chair. Therefore, it is desirable to have arm rests that are adjustable to match the specific anatomy of a given user. A chair, in particular the arm rests, should be comfortable for people of all sizes and shapes. For example, a user having a small body size may desire arm rests that are somewhat closer than those found on a standard size chair. Similarly, a user having a large body size may desire arm rests that are moved outward somewhat from the standard position.

Arm rests should also be angularly adjustable depending on the varied activities of the user of the chair. A user may desire the arm rests in a first angular position when typing or working with a pen and paper on a desk. The user, however, may desire a second angular position when working with a mouse for a computer.

While adjustable arm rests have been previously disclosed, there still exists a need for adjustable arm rests that provide reliable operation.

SUMMARY OF THE INVENTION

Briefly stated, the present invention is directed to an adjustable arm rest assembly for use on a chair including an arm rest post and an arm rest support surface, the support surface being movably attached to the arm rest post. According to one aspect of the invention, the support surface includes a front portion and a rear portion and is pivotable about a pivot axis that extends in parallel with the seat back of the chair. A locking element is attached to one of the arm rest post and the support surface. The locking element includes a front portion and a rear portion with the front portion including a first mating element. The front portions of the support surface and locking element are farther from the seat back than the rear portions. A guide member is attached to the other of the arm rest post and the support surface. The guide member is located adjacent the front portion of the locking element and includes a row of second mating elements that are adapted to receive the first mating element. The locking element and the guide member are movable with respect to one another so that the support surface may be secured in a selected position relative to the arm rest post.

According to another aspect of the invention, an arm rest housing and support surface are laterally adjustable with respect to the arm rest post. According to this aspect, a second guide member having a second row of mating elements is located adjacent the rear portion of the locking element. The arm rest post has a boss extending from a top surface that is received within a slot in the lower surface of the arm rest housing. The slot is sized so as to allow only a lateral movement.

According to a further aspect of the invention, the locking element is attached to the arm rest post and the guide members are attached to the arm rest housing.

According to yet a further aspect of the invention, the locking element is a detent and the guide members are formed by a series of projecting surfaces.

As used herein, the term "arm rest post" is intended to include both male and female elements, e.g., a stem or a sleeve.

The present invention will be best understood with reference to the detailed description below read in conjunction with the accompanying drawings.

DESCRIPTION OF THE PREFERRED EMBODIMENTS

Figure 1:
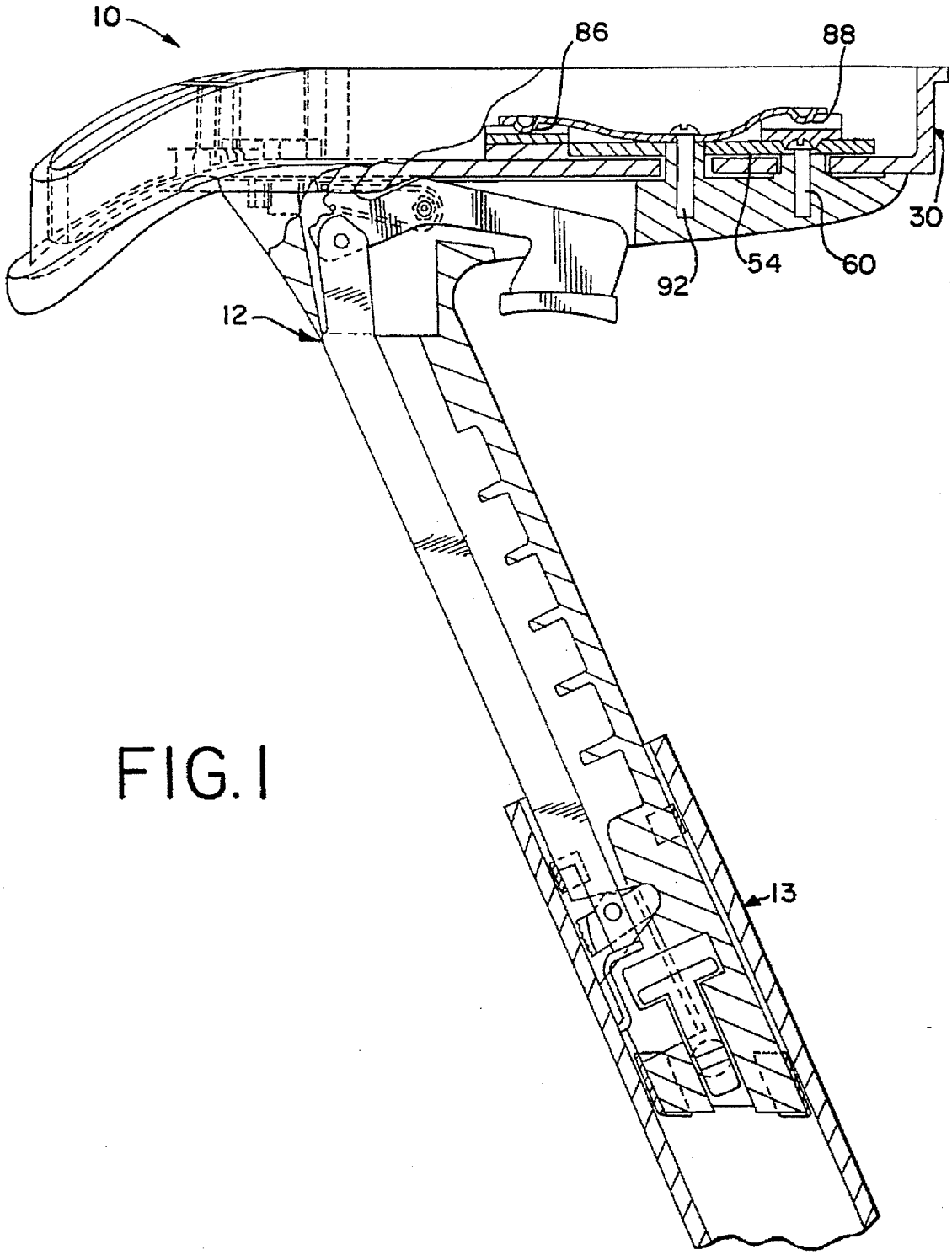
FIG. 1 is a side view in partial cross-section of a preferred embodiment of the adjustable arm rest assembly of the present invention.
Figure 2:
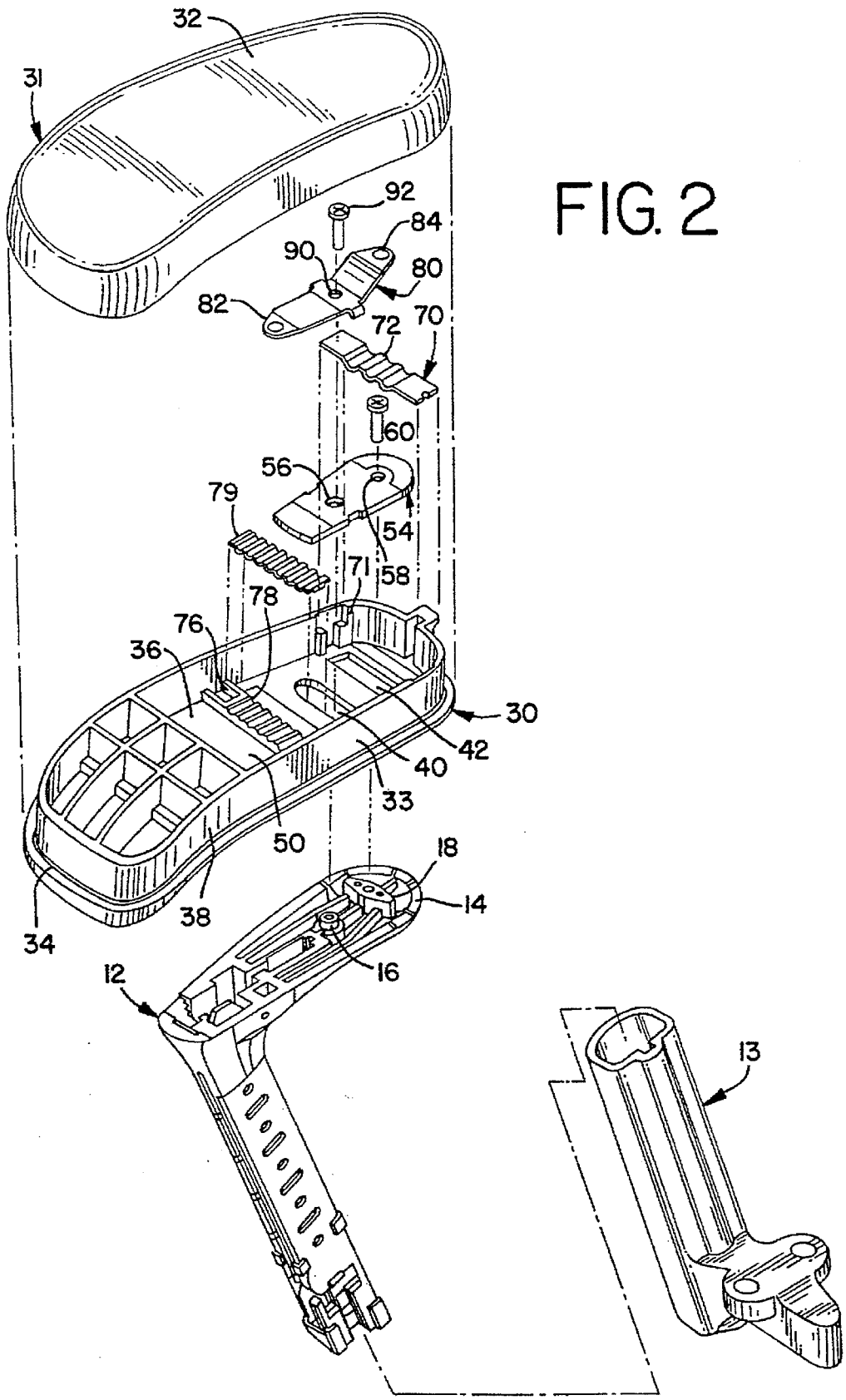
FIG. 2 is an exploded view of a preferred embodiment of the present invention.

Referring to the drawings, FIG. 1 shows an adjustable arm rest assembly 10 for use on a chair having a seat and a seat back. The assembly 10 includes an arm rest post 12, preferably formed from 30% glass-filled nylon, that is slidably received by a support member 13, preferably formed from aluminum. The support member 13 is attached to a chair beneath the seat thereof. As best seen in FIG. 2, the arm rest post 12 has a top surface 14. The top surface 14 includes a first boss 16 and a second boss 18. The first boss 16 has a circular shape and the second boss 18 has a diamond shape.

For a description of the height adjustment assembly including the arm rest post 12 and the support member 13, reference is made to the commonly assigned application filed on Jun. 7, 1995, in the name of Douglas M. Van De Riet, and entitled HEIGHT ADJUSTABLE ARM REST, the disclosure of which is expressly incorporated herein.

A housing 30 is movably mounted to the top surface 14 of the arm rest post 12. The housing 30 is somewhat wider and longer than the top surface 14. An arm pad 31 is attached to the housing 30 and includes an arm support surface 32. The arm pad 31 engages the outer wall 33 of the housing 30 up to the flange 34. The arm pad 31 may be made from materials known to those of ordinary skill in the art. The housing 30 also has a lower surface 36 and a front portion 38. A first slot 40 and a second slot 42 extend in the lower surface 36 of the housing 30. In this embodiment, the first slot 40 has a slightly shorter length than the second slot 42. The first slot 40 receives the first boss 16 and the second slot 42 receives the second boss 18. According to a preferred embodiment, the slots 40 and 42 are sized so that their respective bosses 16 and 18 are freely movable therein in order to allow the housing 30 to be moved both laterally and angularly with respect to the arm rest post 12. According to another preferred embodiment, the slots 40 and 42 are sized so as to restrict the angular movement of the housing 30. More specifically, the slots 40 and 42 would have a width substantially equal to the width of the bosses 16 and 18. As a result, the housing 30 would only be moved in a lateral direction toward or away from a user. The housing 30 is preferably manufactured using an injection molding process with 13% glass-filled polypropylene.

The housing 30 has an internal cavity 50 that is defined in part by the outer wall 33 and the lower surface 36. A cold rolled steel plate 54 is mounted within the cavity 50. The plate 54 has a first aperture 56 and a second aperture 58 therein. The distance between the first aperture 56 and the second aperture 58 is approximately equal to the distance between the first slot 40 and the second slot 42. A fastening mechanism such as the screw 60 passes through the second aperture 58, the second slot 42 and into the second boss 18.

A rear guide member 70, preferably formed from case-hardened cold rolled steel, is also received within the cavity 50 and secured to the housing 30 in the channels 71. The rear guide member 70 is attached to the housing 30 above the second slot 42 and includes a plurality of rear mating elements 72. The mating elements 72 take the form of a plurality of projecting surfaces that form curved channels that extend lengthwise within the cavity 50 or in a direction perpendicular to a corresponding seat back. In this embodiment, three channels comprise the mating elements 72.

A front guide member 76 is formed integral with the housing 30 slightly behind the first slot 40. As with the rear guide member 70, the front guide member 76 has a row of mating elements 78 extending therein. The front mating elements 78 also take the form of a plurality of projecting surfaces that form curved channels that extend lengthwise within the cavity 50 or in a direction perpendicular to a corresponding seat back. In contrast to the rear guide member 70, the front guide member 76 has seven channels. Rather than having uniformly curved channels or projecting surfaces, in another preferred embodiment the mating elements 72 and 78 are modified to have a steeper angle of inclination at the outer edges of the guide members 70 and 76. In this manner, it would require more force for a user to adjust the housing 30 when closer to the ends of the guide members 70 and 76.

A wear strip 79 is attached to the top surface of the front guide member 76 over the mating elements 78 and is configured to conform with the front guide member 76. The wear strip 79 is formed from case-hardened cold rolled steel and functions to protect the front mating elements 78 of the guide member 76 from being worn down.

A locking element or detent spring 80 is positioned within the cavity 50 between the front and rear guide members 70 and 76. The detent 80, preferably formed from spring steel, has front and rear portions 82 and 84 that extend over the front and rear guide members 70 and 76, respectively. The front potion 82 is farther from the seat back of the chair than the rear portion 84. As best seen in FIG. 1, the front and rear portions 82 and 84 have male mating elements that comprise downwardly extending front and rear projecting surfaces 86 and 88. The projecting surfaces 86 and 88 are biased into engagement with the front mating elements 78 and rear mating elements 72, respectively. The detent 80 is configured so as to more strongly bias the rear projecting surface 88 into engagement with the rear mating elements 72 than it biases the front projecting surface 86 into engagement with the front mating elements 76. An aperture 90 is centrally located within the detent 80 and is positioned above the first aperture 56 within the plate 54. A fastening mechanism 92, such as a screw, passes through the aperture 90 of the detent 80 and through the first aperture of plate 54 and the first slot 40 into the boss 16 in the arm rest post 12.

It should be recognized that the specific interconnection of elements could be easily modified by those of ordinary skill in the art so as to still practice the present invention. For example, the preferred embodiment shown in the Figures could be modified so as to change the relative interconnection of the locking element and the guide members with respect to the arm rest post and arm rest housing. More specifically, the guide members could be connected to the arm rest post and the locking element could be connected to arm rest housing. Accordingly, it should be recognized that the preferred embodiment of the applicants' invention shown in the Figures could be modified in a wide variety of ways.

Figure 3:
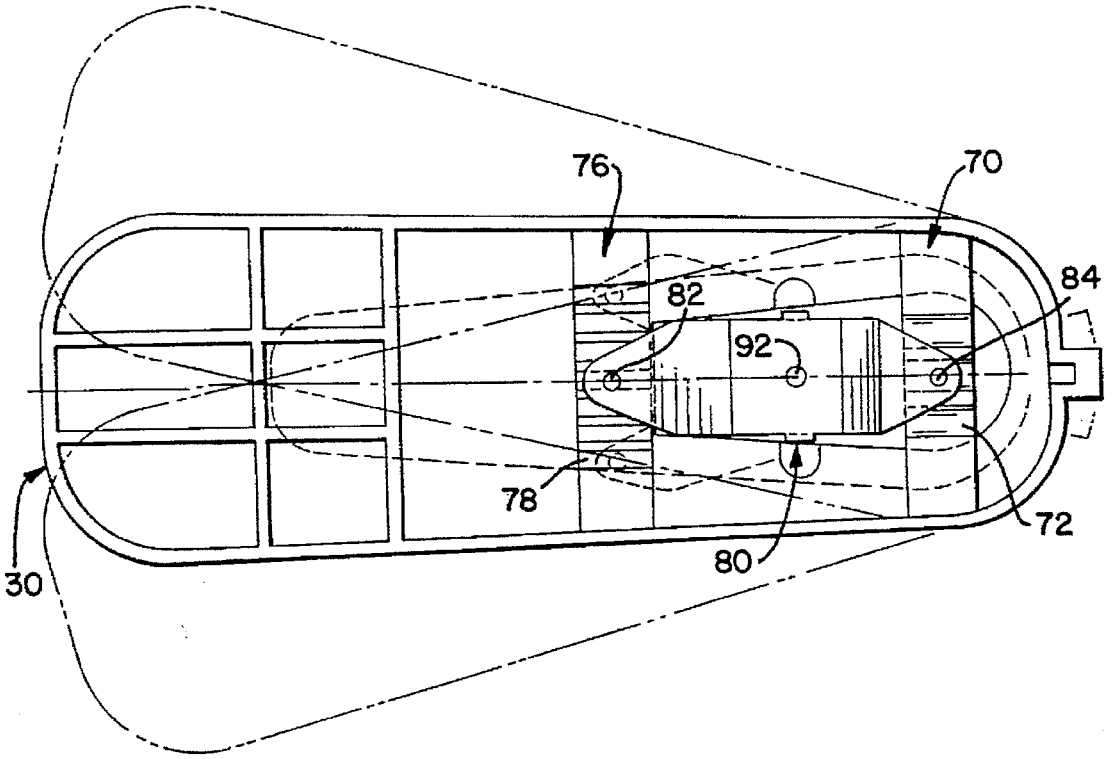
FIG. 3 is a top view of a preferred embodiment of the present invention showing in shadow two different angular positions for the arm rest housing.

In the preferred embodiment shown in FIG. 3, the arm rest housing 30 and attached pad 31 are angularly adjustable with respect to the arm rest post 12 (as shown in shadow). In order to accomplish this adjustment, a user would apply a lateral force to the housing 30 approximately adjacent the front guide member 76. As a result, the front projecting surface 86 is moved from engagement with a first projecting surface of the mating elements 78 to a second projecting surface of the mating elements 78. More specifically, the user overcomes the downward force applied by the front portion 82 of the detent 80. The housing 30 then pivots in the direction of the applied force with the first and second slots 40 and 42 moving with respect to the first and second bosses 16 and 18. During this angular positioning, the rear projecting surface 88 remains fixed within the previously selected channel of the rear mating elements 72. Accordingly, the rear projecting surface 88 forms a pivot member that defines a pivot axis about which the housing 30 rotates.

Figure 4:
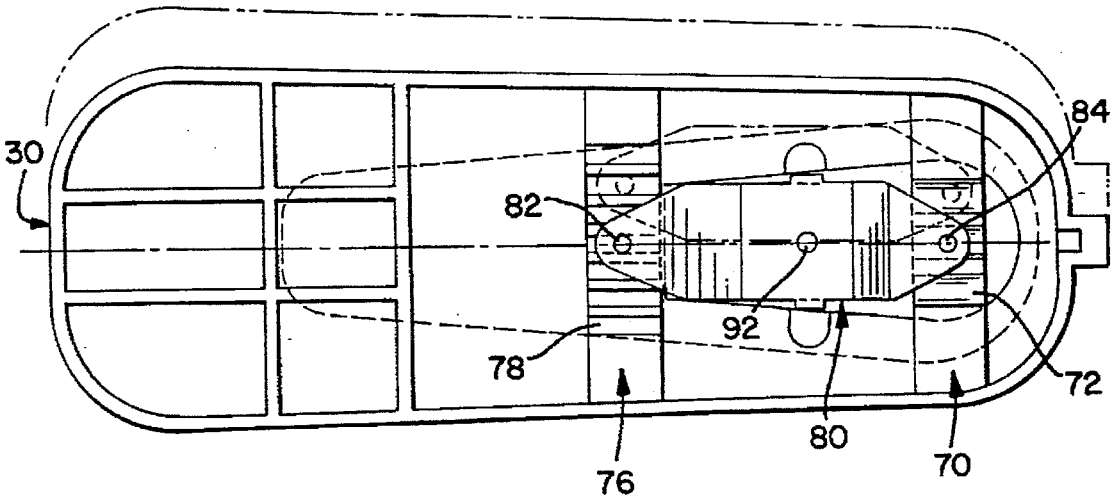
FIG. 4 is a top view of a preferred embodiment of the present invention showing in shadow a different lateral position for the arm rest housing.

As shown in FIG. 4, the arm rest housing 30 and the attached pad are also movable laterally with respect to the arm rest post 12 (as shown in shadow) or toward and away from the user of a chair. In order to accomplish this adjustment, a user would apply a lateral force to the housing 30. However, in contrast with the force applied to move the housing 30 to a new angular position, the force applied by the user should be in between the front and rear guide members 76 and 70. A force applied in this manner moves the front projecting surface 86 from engagement with a first projecting surface of the front mating elements 78 to a second projecting surface of the front mating elements 78. In addition, the rear projecting surface 88 is also moved from engagement with a first projecting surface of the rear mating elements 72 to a second projecting surface of the rear mating elements 72. More specifically, the user overcomes the downward force applied by the front and rear portions 82 and 84 of the detent 80. Accordingly, the housing 30 moves laterally in the direction of the applied force with the first and second slots 40 and 42 again moving with respect to the first and second bosses 16 and 18.

The embodiment described is illustrative and not restrictive. The scope of the invention is indicated by the claims rather than by the foregoing description. The invention may be embodied in other specific forms without departing from the spirit of the invention. For example, the number of projecting surfaces within the front and rear guide members may easily be modified without departing from the spirit of this invention. Similarly, the specific materials used or the configurations of the parts may also be easily changed. Accordingly, all changes which come within the scope of the claims are intended to be embraced therein.

We claim:

1. An angularly adjustable arm rest assembly for use on a chair having a seat back, said arm rest assembly comprising:

an arm rest post;

an arm rest support surface pivotably attached to said arm rest post, said support surface having a front portion and a rear portion, said front portion farther from said seat back than said rear portion, said support surface pivotable about a pivot axis that extends in parallel with said seat back and passes through said rear portion;

a locking element adapted to be fixedly attached to one of said arm rest post and said support surface, said locking element having a front portion and a rear portion, said front portion farther from said seat back than said rear portion, said front portion having a first mating element;

a guide member adapted to be fixedly attached to the other of said arm rest post and said support surface and includes a row of second mating elements, said second mating elements being formed from a plurality of horizontally extending channels, said guide member adapted to receive said first mating element into one of said second mating elements, said locking element and said guide member horizontally slidable with respect to one another whereby said support surface may be secured in a selected angular position relative to said arm rest post through the selective positioning of said locking element with respect to said guide member.

2. The adjustable arm rest assembly of claim 1 wherein said locking element is attached to said arm rest post and said guide member is attached to said support surface.

3. The adjustable arm rest assembly of claim 2 wherein said rear portion of said locking element further comprises a rear pivot member that defines said pivot axis.

4. The adjustable arm rest assembly of claim 3 wherein said second mating elements comprise a plurality of projecting surfaces.

5. The adjustable arm rest assembly of claim 4 wherein said projecting surfaces extend in a direction perpendicular to said seat back.

6. The adjustable arm rest assembly of claim 5 wherein said locking element comprises a detent spring.

7. The adjustable arm rest assembly of claim 6 wherein said support surface further comprises a housing member extending beneath said support surface, said housing also movably attached to said arm rest post.

8. The adjustable arm rest assembly of claim 7 wherein said housing defines a cavity that receives said locking element and said guide member.

9. The adjustable arm rest assembly of claim 8 further comprising a fastening mechanism that passes through an aperture in said locking element, a slot in a lower surface of said housing and is attached to a boss in said arm rest post.

10. A laterally adjustable arm rest assembly for use on a chair having a seat and a seat back that supports a user thereon, said arm rest assembly comprising:

an arm rest post having a boss extending from a top surface;

an arm rest housing having an arm rest support surface, said arm rest housing and support surface slidably attached to said arm rest post, said support surface laterally movable toward and away from said user, said arm rest housing having a front portion, a rear portion and a slot in a lower surface, said slot sized to have a width substantially equal to said boss;

a locking element adapted to be fixedly attached to one of said arm rest post and said arm rest housing, said locking element having a front portion and rear portion, said front portion farther from said seat back than said rear portion, said front portion and said rear portion each having a first mating element;

front and rear guide members adapted to be fixedly attached to the other of said arm rest post and said arm rest housing, said front guide member located adjacent said front portion of said locking element and said rear guide member located adjacent said rear portion of said locking element, said front and rear guide members each including a row of second mating elements adapted to receive said first mating elements, said locking element and said guide members movable with respect to one another whereby said support surface may be secured in a selected lateral position relative to said arm rest post through the selective positioning of said locking element with respect to said front and rear guide members, said boss of said arm rest post and said slot of said arm rest housing cooperating to provide for only a lateral adjustment capability.

11. The adjustable arm rest assembly of claim 10 wherein said locking element is attached to said arm rest post and said front and rear guide members are attached to said arm rest housing.

12. The adjustable arm rest assembly of claim 11 wherein said second mating elements comprise a plurality of projecting surfaces.

13. The adjustable arm rest assembly of claim 12 wherein said projecting surfaces extend in a direction perpendicular to said seat back.

14. The adjustable arm rest assembly of claim 13 wherein said locking element comprises a detent spring.

15. The adjustable arm rest assembly of claim 14 wherein said first mating element comprising a downwardly projecting round surface.

16. The adjustable arm rest assembly of claim 15 wherein said rear guide member has fewer projecting surfaces than said front guide member.

17. The adjustable arm rest assembly of claim 16 wherein said rear portion of said locking element is more strongly biased into engagement with said rear guide member than said front portion of said locking element is into engagement with said front guide member.

18. A laterally and angularly adjustable arm rest assembly for use on a chair having a seat and a seat back that supports a user thereon, said arm rest assembly comprising:

an arm rest post having a boss extending from a top surface;

an arm rest housing having an arm rest support surface, said arm rest housing and support surface laterally and pivotably movable toward and away from said user, said support surface laterally movable toward and away from said user, said arm rest housing having a front portion, a rear portion and a slot in a lower surface, said slot sized to have a width substantially equal to said boss, said front portion farther from said seat back than said rear portion;

a locking element adapted to be fixedly attached to one of said arm rest post and said arm rest housing, said locking element having a front portion and rear portion, said front portion farther from said seat back than said rear portion, said front portion and said rear portion each having a first mating element, said mating element of said rear portion defining a pivot axis;

front and rear guide members adapted to be fixedly attached to the other of said arm rest post and said arm rest housing, said front guide member located adjacent said front portion of said locking element and said rear guide member located adjacent said rear portion of said locking element, said front and rear guide members each including a row of second mating elements adapted to receive said first mating elements, said locking element and said guide members movable with respect to one another whereby said support surface may be secured in a selected lateral or angular position relative to said arm rest post through the selective positioning of said locking element with respect to said front and rear guide members.

19. The adjustable arm rest assembly of claim 18 wherein said locking element is attached to said arm rest post and said front and rear guide members are attached to said arm rest housing.

20. The adjustable arm rest assembly of claim 19 wherein said second mating surfaces comprise a plurality of projecting surfaces.

21. The adjustable arm rest assembly of claim 20 wherein said projecting surfaces extend in a direction perpendicular to said seat back.

22. The adjustable arm rest assembly of claim 21 wherein said locking element comprises a detent spring with said first mating element comprising a downwardly projecting round surface.

23. The adjustable arm rest assembly of claim 22 wherein said rear guide member has fewer projecting surfaces than said front guide member.

24. The adjustable arm rest assembly of claim 23 wherein said rear portion of said locking element is more strongly biased into engagement with said rear guide member than said front portion of said locking element is into engagement with said front guide member.

* * * * *